US006199288B1

(12) United States Patent
Gregory

(10) Patent No.: US 6,199,288 B1
(45) Date of Patent: Mar. 13, 2001

(54) TOOL FOR MARKING LARGE FLAT BUILDING MATERIAL SHEETS

(76) Inventor: Marvin D. Gregory, Rte. 3, Box 127-1, Vinita, OK (US) 74301

( * ) Notice: Subject to any disclaimer, the term of this patent is extended or adjusted under 35 U.S.C. 154(b) by 0 days.

(21) Appl. No.: 09/307,693

(22) Filed: May 10, 1999

(51) Int. Cl.[7] ..... B43L 7/00
(52) U.S. Cl. ..... 33/484; 33/32.2
(58) Field of Search ..... 33/32.2, 416, 430, 33/483, 484, 485, 486, 490

(56) References Cited

U.S. PATENT DOCUMENTS

| | | | | |
|---|---|---|---|---|
| 372,673 | | 11/1887 | Hamilton, Jr. . | |
| 450,735 | * | 4/1891 | Conant | 33/430 |
| 575,671 | | 1/1897 | Watts et al. . | |
| 753,886 | | 3/1904 | Jacobs . | |
| 792,212 | | 6/1905 | Heddle . | |
| 825,150 | | 7/1906 | McCartney . | |
| 833,168 | | 10/1906 | Keller . | |
| 1,056,206 | | 3/1913 | Norman . | |
| 1,074,969 | | 10/1913 | Moore . | |
| 1,084,973 | | 1/1914 | Stanwood et al. . | |
| 1,201,063 | * | 10/1916 | Litchfield | 33/483 |
| 2,580,263 | * | 12/1951 | Wooten | 33/32.2 |
| 2,651,333 | * | 9/1953 | Spinney | 33/430 |
| 2,705,029 | * | 3/1955 | Zophel | 33/430 |
| 2,763,065 | | 9/1956 | Leidahl | 33/173 |
| 2,805,484 | * | 9/1957 | D'Aoust | 33/485 |
| 3,015,163 | | 1/1962 | Cummings | 33/94 |
| 3,292,263 | * | 12/1966 | Barry et al. | 33/32.2 |
| 3,934,350 | | 1/1976 | Pirnie | 33/94 |
| 4,244,118 | * | 1/1981 | Matuszak | 33/430 |
| 4,462,166 | | 7/1984 | Furlong | 33/416 |
| 4,648,185 | | 3/1987 | Brandimarte | 33/189 |
| 5,384,967 | * | 1/1995 | Helmuth | 33/416 |
| 6,029,362 | * | 2/2000 | Miodragovic | 33/485 |

* cited by examiner

*Primary Examiner*—G. Bradley Bennett
(74) *Attorney, Agent, or Firm*—Head, Johnson & Kachigian

(57) ABSTRACT

A tool for use in marking large flat building material sheets, each sheet having a standardized length and a standardized width and having opposed longitudinal side edges to provide a cut line by which each sheet can be dimensionally shaped for installation on a building roof or gable the tool being an elongated bar providing at least one straight edge having a first pin affixed to the bar and extending perpendicular to it and a second perpendicular pin affixed to the bar, the spacing between the first and second pins being adjustably variable, the first and second pins being configured to slidably engage opposed longitudinal side edges of the building material sheets so that the bar straight edge extends at an angle to the longitudinal side edges, the straight edge providing an edge for marking the sheets to provide a guideline for an angle cut, the angle being selectively determined by the spacing between the pins.

7 Claims, 3 Drawing Sheets

TOOL FOR MARKING LARGE FLAT BUILDING MATERIAL SHEETS

REFERENCE TO PENDING APPLICATIONS

This application is not related to any pending United States or international patent application.

REFERENCE TO MICROFICHE APPENDIX

This application is not referenced in any Microfiche Appendix.

BACKGROUND OF THE INVENTION

In the United States and in many other countries of the world today, large flat sheets of standardized length and width are commonly employed. As an example, for frame construction buildings, that is buildings built from wherein the super structure is primarily of wood, typically employing wood rafters, the roof is formed by first laying down on the exposed spaced apart rafters a sheeting of plywood or particle board. In the United States a typical size plywood sheet used for roofing is 4 feet by 8 feet with a thickness of typically ⅜ inches to ¾ inches. If a roof has a valley or a hip it means that some of the 4×8 foot sheets must be cut at an angle at one end to fit the adjoining hip roof or valley. The angle of cut required is determined by the pitch of the roof or the pitch of the hip which the roof intersects. As subsequent rows of building material sheets are attached to a rafter superstructure, sheets are required to complete a row having the same angular cut although the length of the sheet from the angular cut to a square end will vary for each row.

Typically, in installing sheeting on rafters installers on the roof will measure to determine the length of one edge of a 4×8 foot sheet. A workman can then calculate from existing tables the length of the other edge. A straight line is drawn between the markings on the two edges and the sheating is cut along the straight line so that when in position it will match a hip or valley of the roof.

The same procedure is employed when sheets of standardized building material sheets, such as 4×8 foot sheets are installed vertically on the side of a building. If the building has a gable roof, the vertical sheeting must match the angle of the roof as various sheets are employed the same angle cut is required at the point where the sheeting meets the gabled roof. While tables exist that provide the length differential of the parallel side edges of the 4×8 foot sheets to match valley, hips and gable usages it is time consuming to use tables for marking individual sheets in the construction of the roof or gable since particularly for each roof or gable is the same angular relationship existing from the start to the completion of the roof. It is an object of the present invention to provide a tool for use in marking large flat building material sheets in which each sheet has a standardized length and a standardized width and has opposed longitudinal edges to provide dimensional shapes for a series of sheets for completing a roof or a gable.

For background information relating to tools of different kinds used by construction craftsman for providing measurement relationships, reference may be had to the following previously issued U.S. patents:

| U.S. Pat. No. | INVENTOR | TITLE |
|---|---|---|
| 372,673 | Hamilton, Jr. | Lumber Rule |
| 575,671 | Watts et al. | Telescopic Measuring Rule |
| 753,886 | Jacobs | Ruler |
| 792,212 | Heddle | Protractor Gage |
| 825,150 | McCartney | Attachment for Carpenters' Squares |
| 833,168 | Keller | Scale Guard and Marker |
| 1,056,206 | Norman | Rafter Reckoner |
| 1,074,969 | Moore | Combined Level and Square |
| 1,084,973 | Stanwood et al. | Try, Rafter, and Miter Square |
| 2,763,065 | Leidahl | Marking Gage for Rules |
| 3,015,163 | Cummings | Square Attachment |
| 3,934,350 | Pirnie | Photo Cropping Device |
| 4,462,166 | Furlong | Device for Measuring Lengths and Conforming Angles |
| 4,648,185 | Brandimarte | Leveling Tool |

BRIEF SUMMARY OF THE INVENTION

A tool for use in marking large flat building material sheets as provided. The tool is for use for standardized sheets in which each sheet has a standardized length and a standardized width with opposed longitudinal side edges and opposed longitudinal and parallel side edges and paralleled end edges. The tool of this invention is used to provide a cut line, by marking a pencil line by which each sheet can be dimensionally shaped for installation on a building roof or gable. On a roof, the tool can be used for expeditionally marking standardized sheets of building material to match the requirements of hips and valleys.

The tool is in the form of an elongated bar of length greater than the width of the building material standardized sheets for which the tool is designed. For instance, in the United States a standardized shaped sheet for roofing or siding of a frame constructed building is 4×8 feet, that is a standardized building material is 8 feet long and 4 feet wide. The elongated bar preferably made of metal but which could be made of plastic or fiberglass, has a length exceeding the width of the standardized sheet. In the preferred embodiment the elongated bar has an elongated groove extending for a substantial portion of the length of the bar, the groove being positioned between opposed longitudinal side edges and paralleled to the side edges. The elongated bar has at least one straight edge but preferably straight edges formed by each of the opposed parallel side edges. A first pin is affixed to the bar and in the preferred arrangement is fixed in a permanent location adjacent one end of the bar and therefore is not movable. A second pin is affixed to the bar and extends perpendicular to it, especially since the first pin and the second pin being adjustably variable. In the preferred arrangement, the first pin slides in an elongated groove in the bar and is adjustably positionable as a selected position.

For use with standardized building material sheets such as 4×8 foot sheets, indicia is placed on the elongated bar for positioning the second or movable pin, the indicia for marking hips and valleys for roof sheeting is determined by the pitch of the roof on which the sheeting material is employed. The separate indicia are employed for marking sheeting for vertical mounting on a wall structure to conform to a gable.

The tools is used by placing it flat at the bottom side against the top surface of a standardized sheet of building material. One length for a required sheet is measured along one edge of a building of the standardized sheet. This measured length is made by a workman utilizing a tape measure extending it from a sheet which has been secured to an adjacent valley or hip. This measurement is given to a workman, preferably located on the work surface, the marks are made along one edge of the standardized sheet. The tool of this invention is then positioned on the sheet of building material with one straight edge coinciding with the length marking and with the first and second pins engaging the longitudinal side edges of the building material sheet. The workman then marks the straight edge of the tool. This straight edge marking is used to saw the building material sheet to provide an angular edge to conform to the requirements of a hip or valley. Since the same angular relationship exists for each sheet of building material requiring a cut to match a hip or valley the workman need adjust the setting of the second pin on the tool one time, thereafter subsequent sheets are marked as required without the workman making any calculations or measurements to compensate for the hip or valley of a roof or for the gable when the sheeting material is used for covering a sidewall.

A better understanding of the invention will be obtained from the following description in claims, taken into conjunction with the attached drawings.

DESCRIPTION OF THE DRAWINGS

FIG. 1 is a front elevational view of the frame building of FIG. 2 showing decking sheets of building material in place as they would appear prior to the installing of roofing shingles.

FIGS. 6 and 7 show a moveable pin placed in two positions.

DETAILED DESCRIPTION OF A PREFERRED EMBODIMENT

Figure 1:
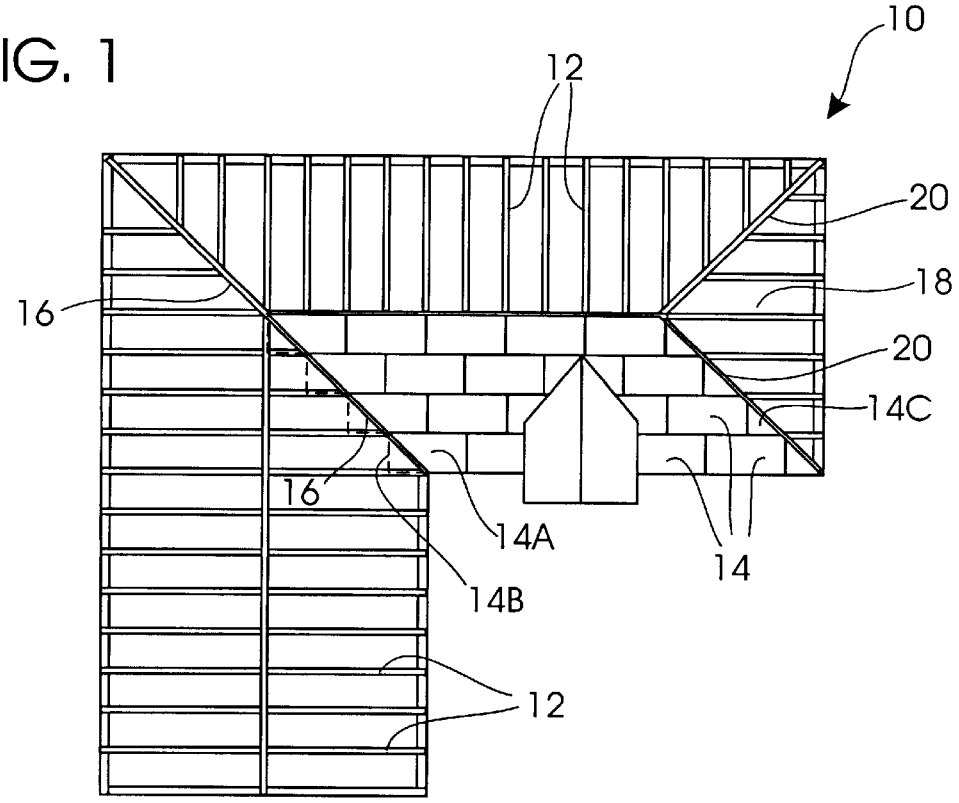
FIG. 1 is a top plan view of a typical house built by frame construction and showing how building material sheets are placed on rafters as part of the construction of a building roof and showing the environment of which the present invention is employed.
Figure 2:
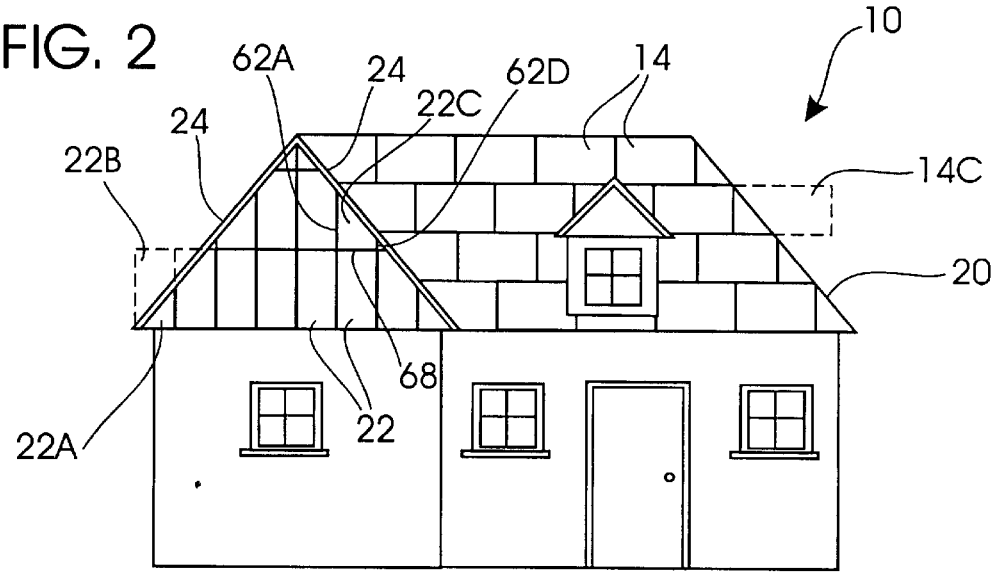
FIG. 2 also shows building sheets installed in a gable portion of the building. This invention is used for marking building sheets of the roof decking and for a building gable.

Referring to the drawings first with reference to FIGS. 1 and 2, the environment in which the tool of this invention is employed will be first discussed a typical mild and relatively simple frame building as indicated by the numeral 10. Typical such that a small frame home as would be built in the United States and Canada and other parts of the world. FIG. 1 shows the top of the building after wood rafters 12 have been installed with the total roof structure ready for roof decking. One portion of the roof is shown with the decking sheets in place, the decking sheets being indicated by the numeral 14. Decking sheets 14 are typically made of plywood or a wood composite such as wafer board. The decking sheets 14 are of a uniform size. In the United states the typical size decking sheet is 4 feet wide by 8 feet long. The thickness of the decking sheets may vary from about ⅜ inches to ¾ of an inch with typical wood decking employed for roofs in the United States for frame buildings being typically ⅜ inch to ⅝ inch. The wood decking 14 are nailed in place on rafters 12 full length sheets and full width sheets are employed except where the sheets must be cut to fit the contour of the roof specifically at the valleys or to fit a hip roof. In FIG. 1, valleys are indicated by the numeral 16 and an area for a gable roof portion by the numeral 18, the gable providing gable lines 20 where the gable roof intersects the other roof surfaces.

As seen in FIG. 1, a decking sheet 14A has been cut where the sheet meets valley 16. That is the dotted portion 14B has been removed from a standard size decking sheet to conform with valley 16. In like manner all of the other decking sheets that begin with valley 16 must have angular portions removed. In similar arrangement, decking sheet 14C has required that a portion be removed to provide an edge conforming to gable line 20. The portion removed from a standard 4×8 foot sheet of building material is seen in dotted outline in FIG. 2.

The tool of this invention is used primarily for marking building material sheets for roof decking to conform to valley and hip requirements however the tool is also used in the same way to conform wall sheets to meet a roof line of a frame building. As seen in FIG. 2, building material sheets 22 which may be typically 4×8 are applied to a vertical wall of the building and must be cut where they meet the roof line 24. A wall sheet 22A as an example has been cut by removing portion 22B.

Figures 6, 7, 8, 9, 10:
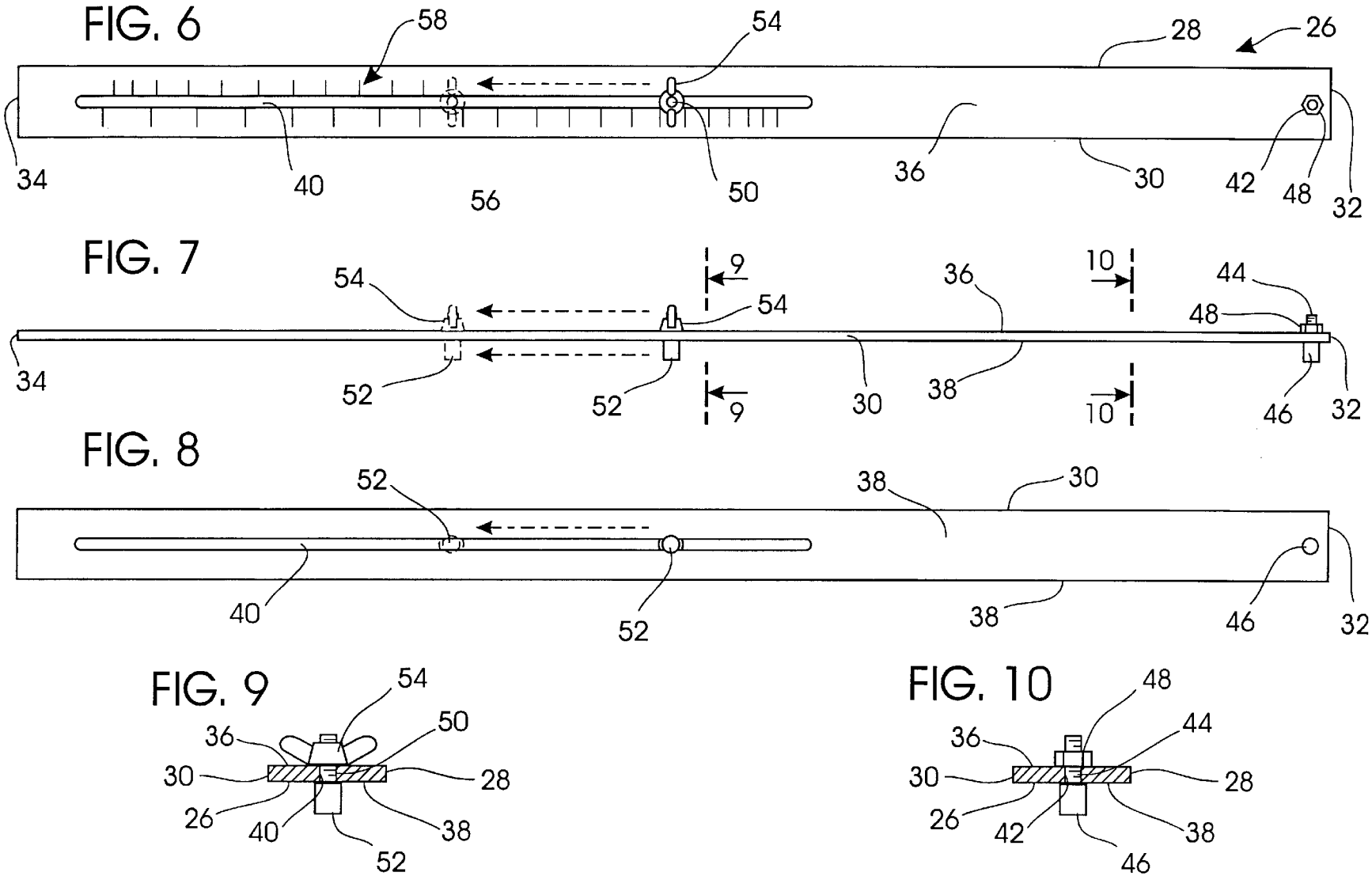
FIG. 6 is a top plan view of the tool of this invention.
FIG. 7 is a elevational side view of the tool shown in FIG. 6.
FIG. 8 is a bottom plan view of the tool as shown in FIGS. 6 and 7.
FIG. 9 is a cross-sectional view taken along the line 99 of FIG. 7 showing the construction of the moveable pin.
FIG. 10 is a cross-sectional view taken along the line 10—10 of FIG. 7 showing the construction of the fixed pin.

The tool that can be used for cutting decking sheets 14 and wall sheets 22 is illustrated in FIGS. 6–8 and in cross-sectional views 9 and 10. The tool is in the form of an elongated bar 26 which is preferably made of metal with aluminum or an aluminum alloy being ideal, but could be made of tough plastic or fiberglass. Bar 26 has opposed longitudinal edges 28 and 30 with ends 32 and 34. The bar has a top surface 36 and bottom surface 38. An elongated slot 40 is formed in the bar between longitudinal edges 28 and 30 and parallel to the edges. The slot 40 preferably extends from adjacent a midpoint of the length of bar 26 toward one end 34.

An opening 42 is formed in the bar adjacent end 32.

The tool is completed by a fixed pin 44 that is received in opening 42. Pin 44, as best seen in cross-sectional view of FIG. 10 has at a lower an enlarged head portion 46 that is preferably cylindrical on its exterior surface. Pin 44 is threaded except for head portion 46 and receives a nut 48.

A movable pin 50, as seen in cross-sectional view of FIG. 9 is shaped exactly like the fixed pin that is it has an enlarged head 52, the pin being threaded and received within slot 40. To permit the moveable pin to be slidably positioned in slot 40 a wing nut 54 is used to hold it in selectable positions. FIGS. 6, 7 and 8 show moveable pin 50 in two selected positions one in dotted outline. FIG. 6, the top view of the tool, shows indicia 56 along one side of slot 40 that is used to set the tool for marking building material sheets used for roof decking to provide the cut lines to match valleys and hips such as valley 16 and hip lines 20 as shown in FIG. 1. On the opposite side of slot 40 are other indicia's 58 used for marking wall panels such as panels 22 of FIG. 2 to match rooflines 24.

Figure 3:
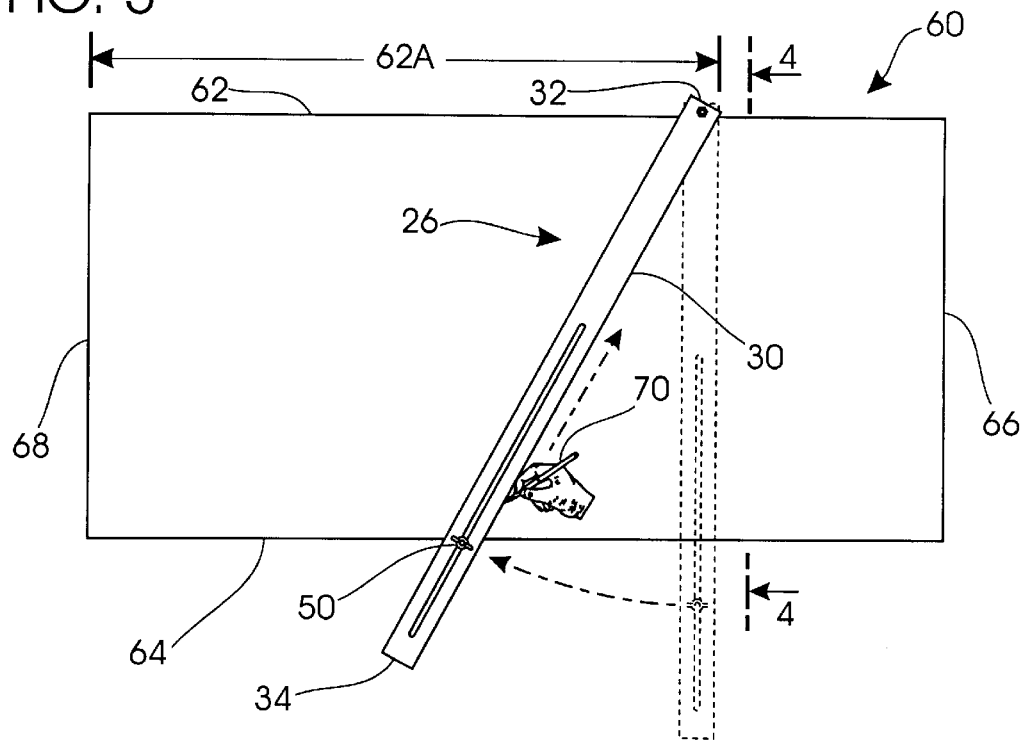
FIG. 3 is a plan view of a typical sheet of building material that, in the United States is typically 4 feet by 8 feet. This invention is concerned with marking decking sheets of a uniform standard width and in some instances a decking sheet may be 4×12.
Figure 4:
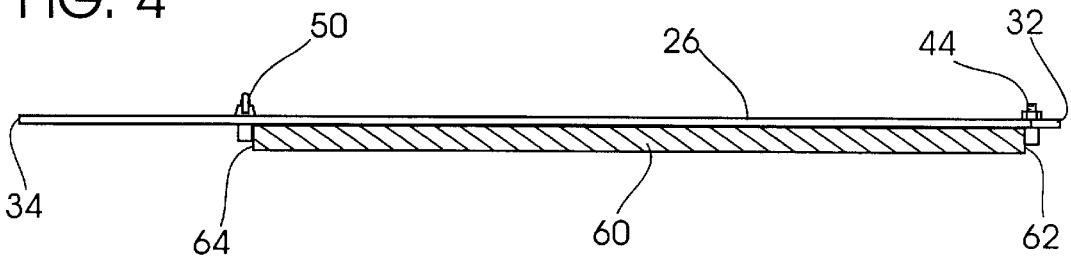
FIG. 4 is a cross-sectional view of the building material sheet of FIG. 3 showing the tool of this as taken along the line 4—4 of FIG. 3.
Figure 5:
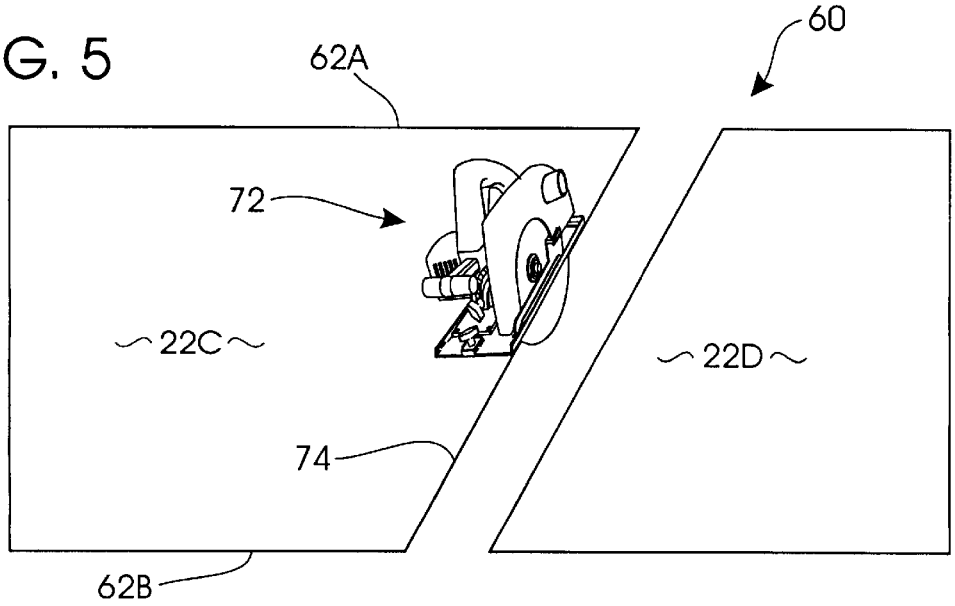
FIG. 5 is a top plan view of the building material sheet of FIGS. 3 and 4 and showing the sheet having been cut by means of a portable power saw as the sheet is typically cut for installation as part of a roof or a wall under a gabled portion of a frame building.

FIGS. 3, 4 and 5 illustrate the method of use of the tool. FIG. 3 shows a sheet of building material 60 having elongated parallel side edges 62 and 64 and end edges 66 and 68. The building material sheet generally indicated by the numeral 60 is of standard dimensions and, as previously indicated, in the United States a typical building material sheet used for roof decking is 4×8, that is the distance between side edges 62 and 64 is 4 feet and the distance between the end edges 66 and 68 is 8 feet with the sheet being approximately ⅜ inch to ¾ of an inch in thickness the same dimension sheets are used as wall sheets 22 as been previously discussed with reference to FIGS. 2. FIG. 3, 4 and 5 show the steps involved in cutting a sheet of wallboards such as the piece indicated by the numeral 22C in FIG. 2. Note that this piece of wallboard to conform to roofline 24 has a bottom edge 68 has a sheet with the bottom edge 68 and with side edges 62A, after the sheet is cut that is less than the full length of side edges 62 and 64 of the full size wall sheet. A craftsman utilizes the tool 26 in this manner. Knowing the slope of roofline 24, such as a 12\12 slope meaning a steep roofline as indicated wherein the roofline 24 rises 12 inches vertically for each 12 inches horizontally, as an example. The craftsman sets the moveable pin 50, according to indicia 56 that indicates the proper setting for a 12\12 pitch. A workman having installed the lower sheets 22 on the building gable wall of FIG. 2, measures the vertical length 62A required for the next higher sheet 22C. This length 62A has been measured on edge 62 of the sheet 60 of FIG. 3. The fixed pin 44 is positioned at the marking indicating the length 62A. The craftsman, then without requiring any other measurement, swings the tool 26 so that moveable pin 50, and specifically the head portion 52A of moveable pin 50, engages the side edge 64 of the sheet 60 being cut. The craftsman then marks a line using vertical edge 30 of the tool 26 by use of a pencil 70 as seen in FIG. 3.

FIG. 4 shows the tool 26 resting on building material sheet 60 with the head of fixed pin 44 against side edge 62 and moveable pin 50 against side edge 64 in the position shown in solid outline in FIG. 3.

FIG. 5 shows a power saw 72 cutting along a marked line 74 as made by pencil 70 in FIG. 3 to provide the correct shaped building material sheet 22C. Thus the building material sheet 22C is formed without requiring a measurement along the edge 62B.

The same procedure can be completed if the craftsman measures the short edge 62B and the tool used as indicated so that there is no requirement for measuring the long edge 62A. Further, the tool does not require any angular measurement to properly cut the cut edge along the marked line 74. The cut off portion 22B of the sheet 60 is waste material S to sheet 60 but not waste material in total since the portion 22D may easily fit for a subsequent portion of the wall being constructed at the gable end of the building at FIG. 2.

The procedure as been described for forming a sheet 22C for use as a wall sheet however the exact same procedure is required to cut sheets 14 as would be necessary to match a valley line 16 or a hip line 20. If a workman on the ground knows the pitch of the roof on which decking is being applied he can, using indicia 58 set the moveable pin 50 at the proper position to give it the necessary angular cut. The workman on the roof doing the installation of the decking need only call down to a workman on the ground either the short length or long length along edge 62 or 64 of the next sheet being installed and the workman can quickly, without making any angular measurements can quickly form a marked line for use in cutting the sheet to the proper shape.

The most important advantage of the tool is the time saving it achieves. A workman need only mark a single measurement along one of the long edges of a building material sheet and then can, with the tool, immediately mark a cut line. Thus, in seconds, a sheet can be marked for cutting compared with the time required for the currently used procedures.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A tool for use in marking large flat building material sheets each sheet having atop and a bottom surface, standardized length "L" and a standardized width "W" and having opposed longitudinal side edges, the tool serving to provide a cut line by which each sheet can be dimensionally shaped for installation on a building roof or gable, comprising:

an elongated unitary bar providing at least one straight uninterrupted edge and having a top surface and a bottom surface, the bottom surface being configured to be positioned in contact with and slide on a building material sheet top surface;

a first pin affixed to said bar and extending perpendicular thereto;

a second pin affixed to said bar and extending perpendicular thereto, the spacing between said first and pins being adjustably variable, the first and second pins each having an enlarged head portion extending from said bar bottom surface and being configured to slidably engage opposed longitudinal side edges of a building material sheet so that said bar straight edge extends at an angle to said building material sheet longitudinal side edges, said straight edge providing an edge for marking a said building material sheet to provide a guideline for an angle cut, the angle being selectively determined by said spacing between said first and second pins.

2. A tool for use in marking large flat building material sheets according to claim 1 wherein said first pin is fixedly secured to said bar at a position adjacent on end thereof and said second pin is adjustably positionable.

3. A tool for use in marking large flat building material sheets according to claim 1 wherein said bar has opposed longitudinal bar edges and an elongated slot therein spaced between the bar edges and paralleled thereto, and wherein at least one of said first and second pins is slidable positionable in said elongated slot.

4. A tool for use in marking large flat building material sheets according to claim 1 wherein at least one of said pins is adjustably positional along said elongated bar by finger tight adjustment.

5. A tool for use in marking large flat building material sheets according to claim 2 including indicia marking on said bar to guide selection of adjustable positionable locations of said second pin.

6. A tool for use in marking large flat building material sheets according to claim 3 wherein said elongated slot is of uniform width and wherein said pin adjustably positionable in said slot has said head portion that is of cross-sectional dimension greater than said width of said slot and a second end portion of cross-sectional dimension less than said width of said slot and slidably received in said slot and an outer end portion of said second end portion is threaded and including a bolt threadably received on said pin second end portion that serving to retain said pin within said slot.

7. A tool for use in marking large flat building material sheets according to claim 6 wherein said bolt has integral finger engaging portion providing for manually tightening and loosening.

* * * * *

UNITED STATES PATENT AND TRADEMARK OFFICE

CERTIFICATE OF CORRECTION

PATENT NO. : 6,199,288 B1
DATED : March 13, 2001
INVENTOR(S) : Gregory

It is certified that error appears in the above-identified patent and that said Letters Patent is hereby corrected as shown below:

Column 2,
Line 49, after "edges" insert -- are --;
Line 54, after "it," insert -- spacing between -- and delete "especially since";
Line 56, after "the" (first occurrence) insert -- second -- and delete "first";
Line 57, delete after "positionable" insert -- at -- and delete "as a";
Line 57, change "position" to -- positions --.

Column 4,
Line 31, after "to" insert -- hip -- and delete "gable".

Claim 1,
Line 28, after "sheets" insert -- , --;
Line 28, after "having" insert -- a top -- and delete "atop";
Line 42, after "and" insert -- second --.

Signed and Sealed this

Eighth Day of January, 2002

*Attest:*

*Attesting Officer*

JAMES E. ROGAN
*Director of the United States Patent and Trademark Office*